United States Patent [19]

Patrick

[11] Patent Number: 5,026,015

[45] Date of Patent: Jun. 25, 1991

[54] SHELF FRAME BRACKET

[76] Inventor: Michael E. Patrick, 9630 N. 100th St., Scottsdale, Ariz. 85258

[21] Appl. No.: 478,914

[22] Filed: Feb. 12, 1990

[51] Int. Cl.[5] ..... A47G 29/02

[52] U.S. Cl. ..... 248/248; 211/186; 248/250; 248/300

[58] Field of Search ..... 248/247, 248, 250, 235, 248/245, 249, 236, 300; 211/188, 186; 182/222; 108/108

[56] References Cited

U.S. PATENT DOCUMENTS

| | | | |
|---|---|---|---|
| 1,894,310 | 1/1933 | Gueth et al. . | |
| 2,157,309 | 5/1939 | Swedman et al. | 248/243 |
| 2,263,282 | 11/1941 | Welch et al. | 248/243 |
| 3,471,112 | 10/1969 | MacDonald et al. | 248/243 X |
| 4,076,203 | 2/1978 | McDonnell | 108/108 X |
| 4,183,488 | 1/1980 | Shepard | 248/247 |
| 4,191,110 | 3/1980 | Klukos | 108/27 |
| 4,231,300 | 11/1980 | Shepard | 108/111 |
| 4,653,712 | 3/1987 | Murray et al. | 248/236 |
| 4,732,358 | 3/1988 | Hughes et al. | 248/243 |
| 4,799,643 | 1/1989 | Shepard | 248/247 X |
| 4,819,901 | 4/1989 | McDonald | 248/243 X |
| 4,856,746 | 8/1989 | Wrobel et al. | 248/250 |
| 4,909,465 | 3/1990 | Lyman | 248/250 |

*Primary Examiner*—Ramon O. Ramirez

*Attorney, Agent, or Firm*—Cahill, Sutton & Thomas

[57] ABSTRACT

A frame bracket for supporting shelf boards includes a rectangular vertically extending main surface. Extending vertically from a first end of the main surface are a plurality of equally spaced first legs. A first horizontally extending arm is located between adjacent first legs. Extending horizontally from a second end of the main surface are a plurality of equally spaced second arms adapted to support an end of a shelf board thereon. A second vertically extending leg is located between adjacent second arms; the second leg extends in a direction opposite from that of the first legs.

11 Claims, 2 Drawing Sheets

SHELF FRAME BRACKET

BACKGROUND OF THE INVENTION

The invention relates generally to frame brackets for constructing shelving. More particularly, this invention relates to frame brackets for supporting precut boards to form shelves.

Shelves are common storage furnishings intended to hold a variety of items such as books, decorative objects and clothes. One frequently used shelf is that located above hanging clothes in a closet. Folded clothes, accessories and the like are commonly stacked on the single closet shelf. However, the stacked items will fall over if stacked much higher than approximately twelve inches. Therefore, the area between the top of the stack to the closet ceiling is unusable storage space.

Shelving can of course be provided by furniture such as bookcases. However, many people needing shelf space do not want to buy expensive furniture simply to store clothes, books and the like; instead, people prefer to modify existing storage spaces by adding shelves supported by brackets such as those disclosed in U.S. Pat. Nos. 4,183,488 and 4,231,300 to Shepard. In the Shepard patents, brackets located on opposite sides of shelves are provided with U-clips that extend underneath and on top of the shelves. The geometry of the brackets precludes placement of one bracket directly above another bracket when constructing multi-shelved units. Therefore, shelving constructed with the Shepard brackets would be difficult to accommodate in limited areas such as closets.

SUMMARY OF INVENTION

Briefly described, and in accordance with one embodiment of the invention, the invention provides a frame bracket for supporting shelf boards to form shelves. The frame bracket includes a rectangular vertically extending main surface. Extending vertically from a first end of the main surface are a plurality of equally spaced first legs. A first horizontally extending arm is located between adjacent first legs. Extending horizontally from a second end of the main surface are a plurality of equally spaced second arms adapted to support an end of a shelf board thereon. A second vertically extending leg is located between adjacent second arms; the second leg extends in a direction opposite from that of the first legs.

It is an object of the present invention to provide an inexpensive, lightweight shelf frame bracket for supporting precut boards which can quickly and easily be assembled into a stable multishelved unit.

It is another object of the present invention to provide a shelf frame bracket for stably supporting a plurality of precut boards which frame bracket can be quickly and easily installed in and removed from an existing storage area without tools and without the need for drilling holes in or otherwise damaging the storage area.

It is another object of the present invention to provide a shelf frame bracket for stably supporting a plurality of precut boards which frame bracket can quickly and easily be permanently installed in an existing storage area such as a closet.

DESCRIPTION OF THE PREFERRED EMBODIMENTS

Figure 1:
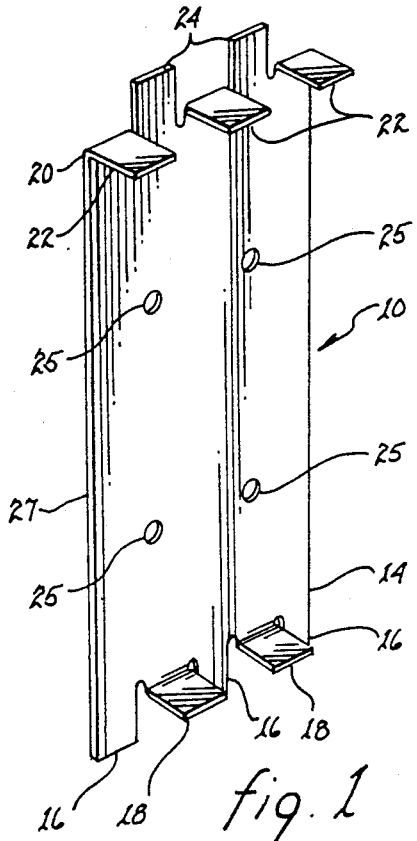
FIG. 1 is a perspective view of a shelf frame bracket of the present invention.

A shelf frame bracket embodying the present invention is shown generally at 10 in FIG. 1. Bracket 10, which is vertically extending and approximately rectangular in shape, can be made either from metal or from a sturdy reinforced plastic; the brackets can be made in different sizes to construct shelves of different heights.

A first end 14 of each bracket 10 contains three equally spaced vertically extending first legs 16, preferably of similar rectangular shape and having a length approximately equal to a standard thickness of precut boards, preferably ¾ inches. Between adjacent first legs 16 is a first horizontally extending arm 18 similar in shape and size to the first legs. A second end 20 of each bracket 10 contains three equally spaced horizontally extending second arms 22 similar in size to and extending in the same direction as first arms 18; the second arms are adapted to support an edge of a shelf board 12. Between adjacent second arms 22 is a second vertically extending leg 24 similar in shape and size to first legs 16; second legs 24 extend in a direction opposite to that of first legs 16. If desired, a plurality of openings 25 adapted to receive screws may be pre-drilled into a main surface 27 of bracket 10 so that the brackets can be permanently attached to existing walls or other fixtures.

Figure 2:
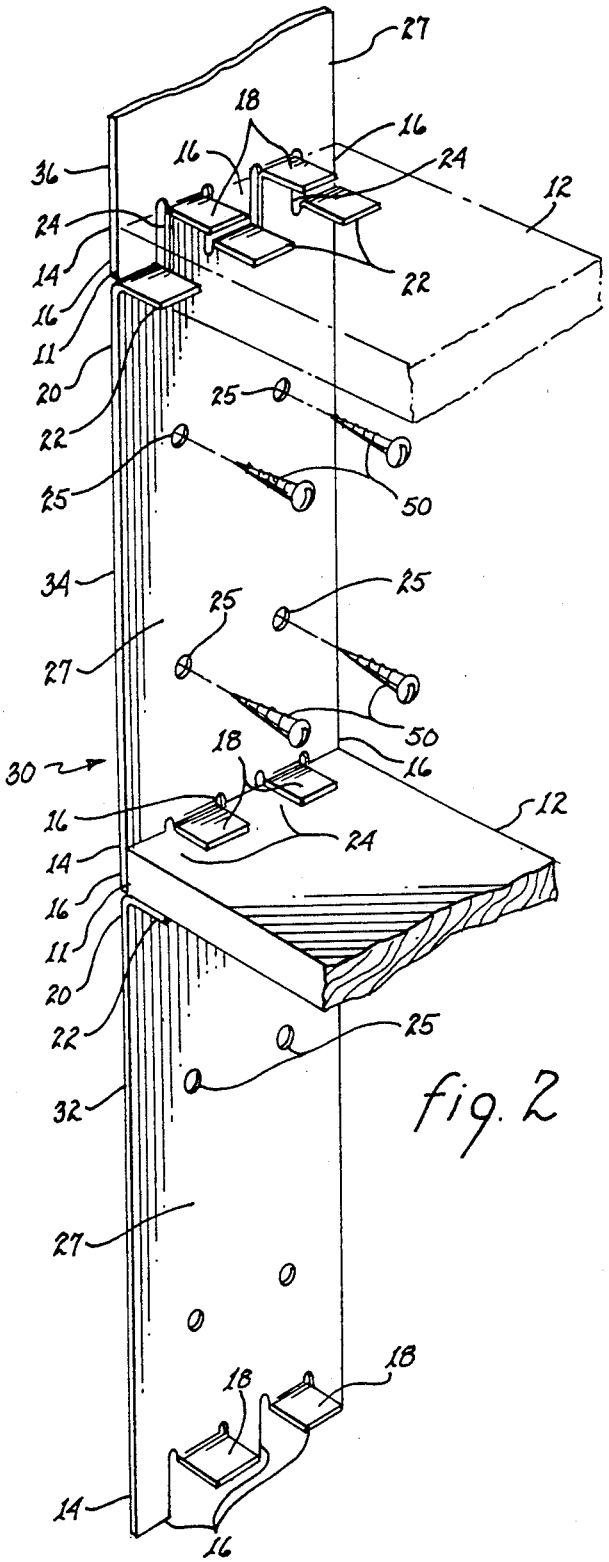
FIG. 2 is a perspective view of a portion of three vertically aligned shelf frame brackets supporting shelf boards.

As shown in FIG. 2, a plurality of brackets 10 can be aligned vertically, one above the other, to form a first bracket set 30, by aligning the first end 14 of a second bracket 34 with the second end 20 of a first bracket 32; the first legs 16 of second bracket 34 are lined up next to the second legs 24 of first bracket 32, and rest on top of second arms 22 of first bracket 32. The two second legs 24 of first bracket 32 fit underneath the two first arms 18 of second bracket 34. The first arms 18 of second bracket 34 and second arms 22 of first bracket 32 are thus spaced apart a distance equal to the length of the first legs 16 and second legs 24, that is, a distance equal to a standard thickness of precut shelf board 12, preferably about ¾ inches. A first end edge 11 of shelf board 12 will thus fit snugly in the space between the first and second arms; the shelf board can vary in width, and need not match the width of bracket 10. If another shelf is desired, bracket set 30 can be enlarged by similarly aligning the first end 14 of a third bracket 36 with the second end 20 of second bracket 34, thereby providing support for the first end edge 11 of another shelf board 12.

Figure 4:
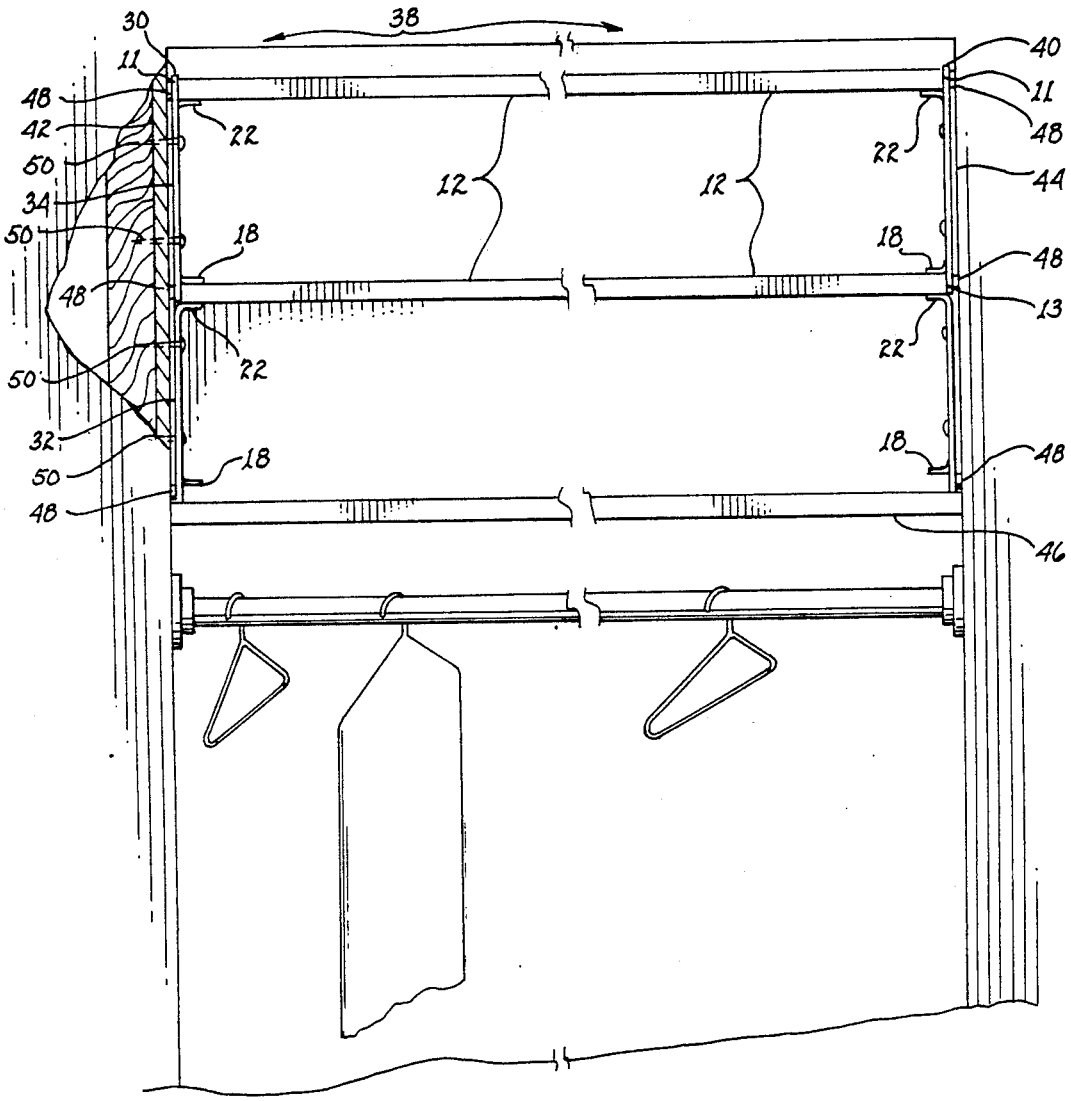
FIG. 4 is a front elevational view of the shelf frame formed by shelf frame brackets of the present invention installed in a storage area.

FIG. 4 illustrates a frame 38 created by constructing opposing first and second bracket sets 30 and 40, respectively, from vertically aligned brackets 10. The first end edge 11 of shelf board 12 is supported by the aligned first bracket 32 and second bracket 34; a second end edge 13 of the shelf board is similarly supported by opposing brackets of bracket set 40.

Figure 3:
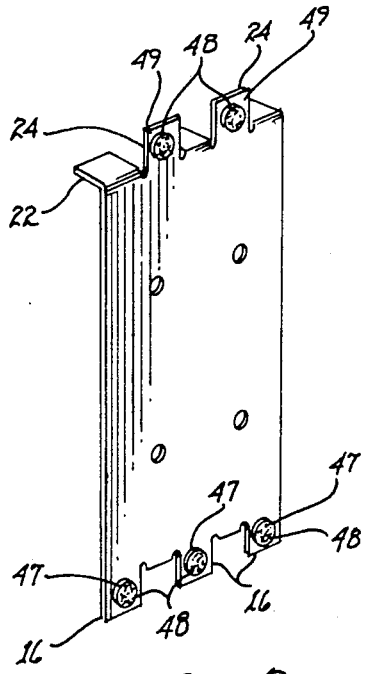
FIG. 3 is a perspective view of the back of the shelf frame bracket of FIG. 1.

As shown in FIG. 4, to install frame 38 in a closet, respective first and second bracket sets 30 and 40 are placed against opposing closet side walls 42 and 44, either on the floor of the closet or on an existing closet shelf 46. A shelf board 12 is then placed between the opposing pairs of first and second arms 18 and 22, respectively. Rubber or cork protective feet 48 (shown in detail in FIG. 3) are glued or otherwise attached to the backs 47 and 49 of first legs 16 and second legs 24 to frictionally engage bracket sets 30 and 40 against side walls 42 and 44, respectively, and protect the side walls from damage by the brackets 10. Frame 38 can be removed from the closet in a matter of minutes by removing boards 12 and disassembling bracket sets 30 and 40.

If, however, frame 38 is to be permanently installed in the closet, holes corresponding in position to bracket openings 25 can be drilled in side walls 42 and 44; screws 50 can then be inserted in the holes and openings, thereby securing the frame to the walls. A permanently installed frame 38 can of course be removed by taking out screws 50 and disassembling the frame.

Other objects, advantages and features of the present invention will become apparent from the following specification when taken in conjunction with the accompanying drawings.

I claim:

1. A frame bracket for supporting shelf boards, the frame bracket comprising:

a. a rectangular vertically extending main surface;

b. three equally spaced first legs extending vertically from a first end of the main surface;

c. a first horizontally extending arm located between adjacent first legs;

d. three equally spaced second arms extending horizontally from a second end of the main surface in the same direction as the first arms, the second arms adapted to support an edge of a shelf board thereon;

e. a second vertically extending leg located between adjacent second arms, the second leg extending in a direction opposite from that of the first legs; and f. wherein the first and second legs are approximately the same shape and have a length approximately equal to a standard shelf board thickness.

2. The frame bracket of claim 1, wherein the first and second legs are approximately ¾ inches long.

3. The frame bracket of claim 1 wherein the main surface, first and second legs, and first and second arms are made from metal.

4. The frame bracket of claim 1 wherein the main surface, first and second legs, and first and second arms are made from reinforced plastic.

5. The frame bracket of claim 1 wherein the main surface contains an opening adapted to receive a screw therein.

6. A frame bracket for supporting a pre-cut shelf board, the frame bracket comprising:

a. a rectangular vertically extending main surface containing an opening adapted to receive a screw therein;

b. three equally spaced first legs extending vertically from a first end of the main surface;

c. a first horizontally extending arm located between adjacent first legs;

d. three equally spaced second arms extending horizontally from a second end of the main surface, the second arms adapted to support an edge of the shelf board thereon;

e. a second vertically extending leg located between adjacent second arms, the second leg extending in a direction opposite from that of the first legs; and f. wherein the main surface, first and second legs, and first and second arms are made from metal, and wherein the first and second legs are approximately the same rectangular shape and are approximately ¾ inches long.

7. A shelf comprising a horizontally extending shelf board supported by a pair of opposing shelf brackets, wherein each of the shelf brackets comprises:

a. a rectangular vertically extending main surface;

b. three equally spaced first legs extending vertically from a first end of the main surface;

c. a first horizontally extending arm located between adjacent first legs;

d. three equally spaced second arms extending horizontally from a second end of the main surface in the same direction as the first arms, the second arms adapted to support an edge of the shelf board thereon;

e. a second vertically extending leg located between adjacent second arms, the second leg extending in a direction opposite from that of the first legs; and f. wherein the first and second legs are approximately the same shape and have a length approximately equal to a standard shelf board thickness and the second arms of the opposing shelf brackets support opposing end edges of the shelf board.

8. A shelf comprising a horizontally extending shelf board supported by a pair of opposing shelf bracket sets, each of the shelf bracket sets comprising first and second vertically aligned shelf brackets wherein each of the shelf brackets comprises:

a. a rectangular vertically extending main surface containing an opening adapted to receive a screw therein;

b. three equally spaced first legs extending vertically from a first end of the main surface;

c. a first horizontally extending arm located between adjacent first legs;

d. three equally spaced second arms extending horizontally from a second end of the main surface in the same direction as the first arms, the second arms adapted to support an end edge of the shelf board thereon;

e. a second vertically extending leg located between adjacent second arms, the second leg extending in a direction opposite form that of the first legs; and f. wherein the first and second legs are approximately the same rectangular shape and are approximately ¾ inches long and the first legs of the second bracket are lined up next to the second legs of the first bracket, the first arms of the second bracket and second arms of the first bracket thus being spaced apart a distance equal to the length of the first and second legs, the distance being sufficient to receive the end edge of a shelf board therebetween.

9. The shelf of claim 8, wherein the shelf brackets are made from metal.

10. The shelf of claim 8, wherein the shelf brackets are made from reinforced plastic.

11. The shelf of claim 9 wherein the main surfaces of the shelf brackets contain an opening adapted to receive a screw therein.

* * * * *